US009090093B2

(12) United States Patent
Izawa et al.

(10) Patent No.: US 9,090,093 B2
(45) Date of Patent: Jul. 28, 2015

(54) INK JET RECORDING APPARATUS

(75) Inventors: Hideo Izawa, Narashino (JP); Takao Namiki, Narashino (JP); Yasushi Katagiri, Narashino (JP); Akira Ishikawa, Narashino (JP)

(73) Assignee: MIYAKOSHI PRINTING MACHINERY CO., LTD., Narashino-shi (JP)

( * ) Notice: Subject to any disclaimer, the term of this patent is extended or adjusted under 35 U.S.C. 154(b) by 771 days.

(21) Appl. No.: 12/537,559

(22) Filed: Aug. 7, 2009

(65) Prior Publication Data

US 2010/0194814 A1 Aug. 5, 2010

(30) Foreign Application Priority Data

Feb. 4, 2009 (JP) ..... 2009-023501

(51) Int. Cl.

| | |
|---|---|
| ***B41J 2/01*** | (2006.01) |
| ***B41J 3/407*** | (2006.01) |
| ***B41J 11/42*** | (2006.01) |
| ***B41J 15/00*** | (2006.01) |

(52) U.S. Cl.

CPC ..... *B41J 3/4078* (2013.01); *B41J 11/425* (2013.01); *B41J 15/005* (2013.01)

(58) Field of Classification Search

CPC ..... B41J 11/007; B41J 11/06; B41J 11/0085; B41J 13/103; B41J 11/0065

USPC ..... 347/104, 101

See application file for complete search history.

(56) References Cited

U.S. PATENT DOCUMENTS 1,966,214 A * 7/1934 Palmer ..... 242/413.5
2,105,824 A * 1/1938 Simonds ..... 226/10

(Continued)

FOREIGN PATENT DOCUMENTS

EP 1674275 A2 6/2006
EP 2216181 A1 * 8/2010 ..... B41J 3/407

(Continued)

OTHER PUBLICATIONS

European Search Report dated Jun. 23, 2010, issued in corresponding European Patent Application No. 09167916.7.

*Primary Examiner* — Manish S Shah
*Assistant Examiner* — Yaovi Ameh
(74) *Attorney, Agent, or Firm* — Westerman, Hattori, Daniels & Adrian, LLP

(57) ABSTRACT

An ink jet recording apparatus in which a fabric as a recording medium is intermittently conveyed in an ink jet recording section is capable of printing an image on the fabric with precision and at high quality. The ink jet recording section of serial printing type includes a conveyer for intermittently conveying the fabric. Printing on the fabric intermittently conveyed in the ink jet recording section, the fabric printing ink jet recording apparatus with the conveyer intermittently conveying the fabric while it is temporarily stuck on the conveyer, includes: a feed roll for continuously feeding the fabric onto an upstream end of the conveyer, and a dancer roll unit, the feed roll and dancer roll unit being disposed upstream of the ink jet recording section in order from upstream in the traveling direction of the fabric; and a drying section, and a traction roll for continuously pulling the fabric from a downstream end of the conveyer for unsticking the fabric from the latter, the drying section and traction roll unit being disposed downstream of the ink jet recording section in order from upstream in the traveling direction of the fabric.

9 Claims, 5 Drawing Sheets

(56) References Cited

U.S. PATENT DOCUMENTS

| | | | | |
|---|---|---|---|---|
| 2,872,188 | A * | 2/1959 | Harkins et al. | 242/419.4 |
| 3,338,770 | A * | 8/1967 | Billingsley et al. | 156/359 |
| 3,659,767 | A * | 5/1972 | Martin | 226/195 |
| 4,214,943 | A * | 7/1980 | Stern | 156/504 |
| 4,765,598 | A * | 8/1988 | Magnuson et al. | 266/110 |
| 5,345,863 | A * | 9/1994 | Kurata et al. | 101/126 |
| 5,501,149 | A * | 3/1996 | Schleinz et al. | 101/416.1 |
| 5,724,085 | A * | 3/1998 | Inui et al. | 347/175 |
| 6,174,055 | B1 * | 1/2001 | Sugikubo et al. | 347/89 |
| 6,206,071 | B1 * | 3/2001 | Majkrzak et al. | 156/519 |
| 6,827,817 | B2 * | 12/2004 | Bleckmann et al. | 156/73.1 |
| 7,774,085 | B2 * | 8/2010 | Yang | 700/126 |
| 8,042,929 | B2 * | 10/2011 | Yokoyama | 347/102 |
| 8,275,302 | B2 * | 9/2012 | Sako et al. | 399/350 |
| 8,422,932 | B2 * | 4/2013 | Steven | 399/398 |
| 2002/0054781 | A1 * | 5/2002 | Korem | 400/621 |
| 2002/0154202 | A1 * | 10/2002 | Yamamoto et al. | 347/104 |
| 2004/0017456 | A1 * | 1/2004 | Obertegger et al. | 347/104 |
| 2004/0233265 | A1 * | 11/2004 | Kojima et al. | 347/102 |
| 2005/0212882 | A1 * | 9/2005 | Naniwa | 347/102 |
| 2005/0280678 | A1 * | 12/2005 | Bibl et al. | 347/85 |
| 2006/0132575 | A1 * | 6/2006 | Fukuda | 347/104 |
| 2008/0068431 | A1 * | 3/2008 | Yokoyama | 347/102 |
| 2008/0283567 | A1 * | 11/2008 | Yang | 226/1 |
| 2010/0008707 | A1 * | 1/2010 | Sako et al. | 399/350 |
| 2010/0194814 | A1 * | 8/2010 | Izawa et al. | 347/16 |
| 2011/0211886 | A1 * | 9/2011 | Moore | 399/398 |
| 2013/0298431 | A1 * | 11/2013 | Hiraoka et al. | 38/52 |
| 2014/0045666 | A1 * | 2/2014 | Endou et al. | 493/186 |

FOREIGN PATENT DOCUMENTS

| | | | | |
|---|---|---|---|---|
| JP | 8-311782 | A | 11/1996 | |
| JP | 08302576 | A * | 11/1996 | D06P 7/00 |
| JP | 08311782 | A * | 11/1996 | D06P 5/00 |
| JP | 2003-167633 | A | 6/2003 | |
| JP | 2005-186419 | A | 7/2005 | |
| JP | 2008285788 | A * | 11/2008 | |

* cited by examiner

INK JET RECORDING APPARATUS

TECHNICAL FIELD

The present invention relates to a textile printing ink jet recording apparatus designed to print on a fabric in a serial printing ink jet recording section.

BACKGROUND ART

In a conventional textile printing ink jet recording apparatus of serial printing in the prior art, a loop making section is provided at each of the upstream and downstream sides in the traveling direction of a fabric fed intermittently in an ink jet recording section, whereby the amount of a loop made in the loop making section is detected to control fabric conveying units on a fabric supply section at the upstream side and a drying section at the downstream side (see JP 2005-186419 A).

In the conventional apparatus mentioned above, with such a looped portion of fabric made free, increasing demands to rise its printing speed in recent years have tended to make its printing quality liable to influences from feeding the fabric intermittently in its ink jet recording section. As a result, an improved method of supplying a fabric at increased stability is being sought.

Also, in the case of a control method by an amount of loop, it is primary to controllably start and cease operating the fabric supply and drying sections as well. This has, however, led to the problem that a temporary load produced in the fabric supply section makes it unstable to convey the fabric and also the problem that the need to repeatedly start and cease conveying the fabric in the drying section easily causes a drying spot and makes it difficult to stably achieve uniformity in printing density and coloring.

In the fabric supply section there have been provided a dust removing unit for removing attachments such as dust to fabric surfaces and a cloth guide for removing longitudinal veining that may be produced in a fabric flow direction. Such a cloth guide comprises guide rollers which are designed to extend the fabric towards opposed external sides of the fabric in its width direction orthogonal to a fabric conveying direction and which are disposed at opposed external ends of the fabric in its width direction.

While such a dust remover and a cloth guide are allowed to effectively function with stability in the continuous traveling state of the fabric, in the operating state needed to repeatedly start and cease conveying the fabric they cause the problem that suction to remove dust while the fabric is at a halt may cause the fabric fibers to partially distort and may make the fibers uneven in property and the problem that in the cross guide section, unevenness in mechanical load is liable to occur and longitudinal veining cannot be removed stably.

In view of the above, it is an object of the present invention to provide an ink jet recording apparatus in which a fabric as a recording medium is fed intermittently in an ink jet recording section, wherein the apparatus is capable of printing an image on the fabric with precision and high quality.

DISCLOSURE OF THE INVENTION

In order to achieve the object mentioned above, there is provided in accordance with the present invention an ink jet recording apparatus for textile printing having an ink jet recording section of serial printing type including a conveyer for intermittently conveying a fabric to print on the fabric intermittently conveyed in the ink jet recording section, characterized in that the conveyer is adapted to convey the fabric while the fabric is stuck onto the conveyer and the apparatus comprises:

a feed roll for continuously feeding the fabric onto an upstream end of the said conveyer, and a dancer roll unit, the said feed roll and dancer roll unit being disposed upstream of the said ink jet recording section in order from upstream in the traveling direction of the fabric; and a drying section, and a traction roll for continuously pulling the fabric from a downstream end of the said conveyer for detaching the fabric from the latter, the said drying section and traction roll unit being disposed downstream of the said ink jet recording section in order from upstream in the traveling direction of the fabric.

The ink jet recording apparatus mentioned above may comprise:

a drive motor for driving said feed roll, a dancer roll operation detecting means disposed in the said dancer roll unit for detecting a dancer roll operation of the said dancer roll unit, and a controller for controllably adjusting drive speed of the said drive motor in response to a signal from the said dancer roll operation detecting means.

The ink jet recording apparatus mentioned above may also include:

a fabric sensor means for providing a detection signal which indicates that the unsticking position of the fabric in the downstream end of the said conveyer deviates from a predetermined range of position, and a controller in response to the detection signal from the said fabric sensor for increasing and decreasing the rate of traction by the said traction roll.

The drying section may comprise a first dryer for blowing hot air orthogonally to surfaces of the fabric and a second dryer for blowing hot air obliquely to surfaces of the fabric, the second dryer being disposed upstream of the first dryer.

The dryers may be made movable towards and away from surfaces of the fabric.

According to the present invention, a fabric is allowed to travel continuously in the upstream of an ink jet recording section of serial printing type in which the fabric is intermittently conveyed, whereby it is ensured that the fabric supplied from the fabric supply section can, upon removal of crinklings, veining and dust through a cloth guide and a center guide, be fed into the ink jet recording section in the state that the fabric is cleaned and smoothened, thereby allowing an image to be printed on the fabric with precision and at high quality.

It is also ensured that in a drying section disposed downstream of the ink jet recording section in which the fabric is intermittently conveyed, the fabric can be dried while traveling at a fixed speed without slackening, thereby allowing printed products free from unevenness in printing density and coloring and stable in quality to be produced.

Also, according to the present invention, a fabric fed into the ink jet recording section in which it is conveyed intermittently can be adequately controlled on its tension. Further, the ability to keep the fabric being conveyed in the state that it is controlled on its tension allows the fabric to be conveyed stably in the ink jet recording section. In addition, the ability to feed the fabric continuously, without reliance on any action to start and cease feeding it, into the ink jet recording section not only improves its printed quality in the ink jet recording section but also even with an increased speed of its conveyance there allows printed products to be produced stably, thereby improving their productivity.

Further, the fabric upstream of the ink jet printing section can be adjusted on its tension with precision and easily. Thus, it is made possible for products to be produced stably at an increased rate of production and with precision, from fabric materials which are thick, thin, hard or soft and of a wide range of properties usable.

And, although in the conventional apparatus in which a fabric is intermittently fed in the fabric supply section, such devices as a center guide which while a sensor senses lateral positions of the fabric is intended to maintain a traveling fabric at a fixed lateral position constantly, a dust remover and a cloth guide have failed to fully exercise their intended performance, it is found that these devices become capable of functioning well as desired at high performance when the fabric is continuously fed in the fabric supply section in accordance with the present invention.

Besides, in accordance with the present invention, a fabric printed in the ink jet recording section can be preliminarily dried by hot air blown out obliquely to surfaces of the fabric from an upstream dryer while preventing undried ink from diffusing to run, whereafter it can be dried by hot air blown out orthogonally to its surfaces from a downstream dryer, thus giving rise to a sharp image without ink blur.

Also, by making each of the driers movable towards and away from surfaces of the fabric, each dryer can be moved towards and away from printed surfaces of the fabric in synchronism with their passing as the unit starts and ceases driving. Possible damage of the fabric by hot air is thus effectively prevented.

BEST MODES FOR CARRYING OUT THE INVENTION

Figure 1:
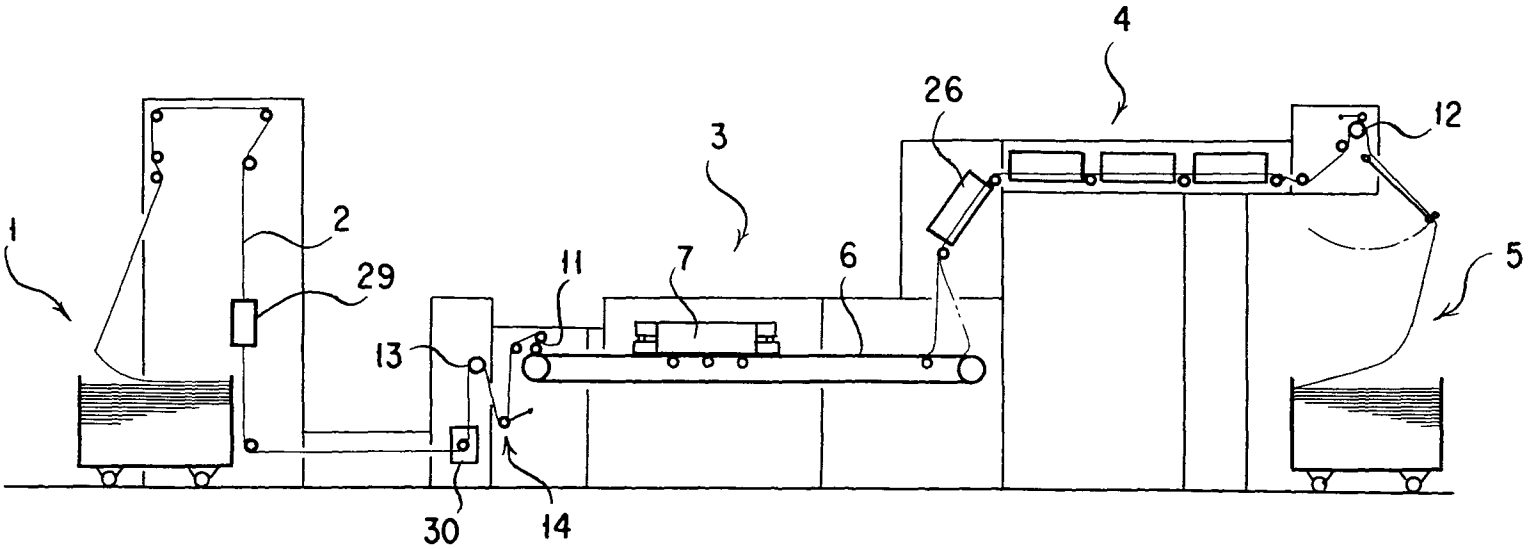
FIG. 1 is a front view diagrammatically illustrating an ink jet recording apparatus according to the present invention.

FIG. 1 is a front view that diagrammatically illustrates the makeup of an ink jet recording apparatus implemented in accordance with the present invention. The apparatus is shown to include a fabric supply section 1 that supplies a fabric 2 as a recording medium, an ink jet recording section 3 for printing on a surface of the fabric 2 with ink jet as the fabric 2 is driven to travel, a drying section 4 and a folder section 5. And, the ink jet recording section 3 comprises a conveyer 6 for conveying the fabric 2 and a recording head unit 7 of serial printing type disposed as opposed to the conveyer 6 from its upper side.

The conveyer 6 is designed to intermittently operate, interlocked with an operation of the recording head unit 7.

Figure 2:
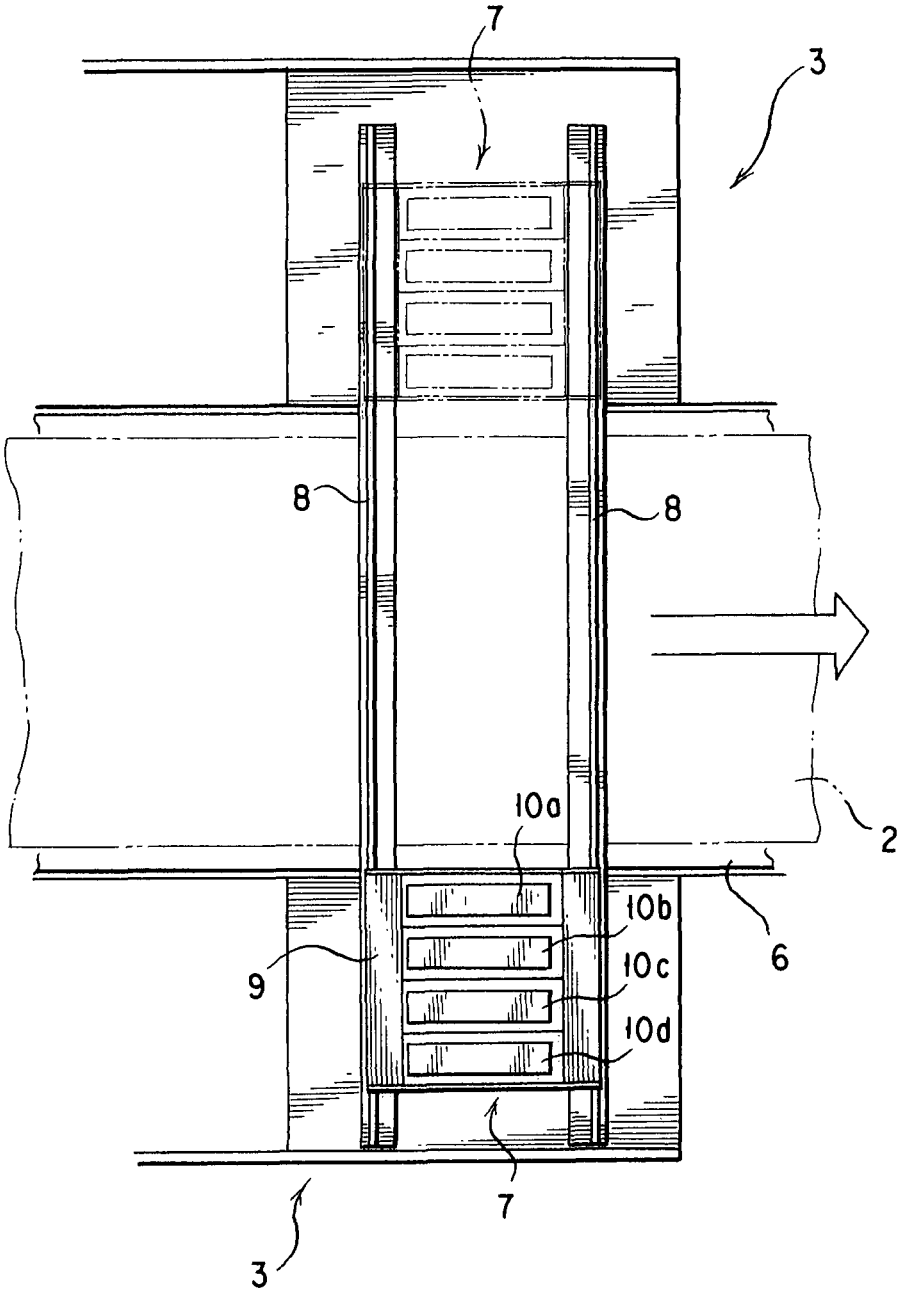
FIG. 2 is a plan view diagrammatically illustrating the ink jet recording section shown in FIG. 1.

The recording head unit 7 as shown in FIG. 2 comprises a plurality of, say four (Y, M, C and K) rows of line heads 10*a*, 10*b*, 10*c* and 10*d* which are disposed on a carriage 9 movable on rails 8 and 8 in a direction orthogonal to the traveling direction of the fabric 2 and which are arranged parallel to each other in the moving direction of the carriage 9 so that rows of their nozzles lie parallel to the traveling direction of the fabric 2. And, the recording head unit 7 is designed to effect one cycle of printing each time the carriage is moved unidirectionally or reciprocated in the state that the fabric 2 is at a halt. Thereafter, the fabric 2 is conveyed to travel, by a length of the line heads 10*a*-10*d* or a length that is the sum of the length of the line heads 10*a*-10*d* plus a given length, and is then brought to a halt so that such a printing operation is repeated. Thereby on a surface of the fabric 2 an image continuous over a selected length in its traveling direction or images mutually spaced apart with a given spacing in the its traveling direction are repeatedly printed.

The conveyer 6 is provided on its surface with stickiness such that the fabric 2 can be stuck thereto and unstuck therefrom. Pressed by a sticking roll 11 disposed at an upstream end of a fabric conveying area of the conveyer 6, the fabric 2 passing is temporarily stuck onto the fabric conveying section of the conveyer 6, then traveling as it is integral with the conveyer 6.

The fabric conveying area of the conveyer 6 has a downstream end facing an upstream side of the drying section 4. A traction roll 12 is disposed at a downstream side of the drying section 4, e.g., in the folder section 5, to pull and thereby unstick the fabric 2 from the conveyer 6 at its downstream end of the fabric conveying area, then allowing the unstuck fabric 2 to travel into the drying section 4. The traction roll 12 is designed to continuously convey the fabric 2 at a speed that is an average of speeds at which it is conveyed intermittently by the conveyer 6.

Provided upstream of the conveyer 6 are a feed roll 13 that feeds the fabric 2 from the fabric supply section 1 onto the conveyer 6 and a dancer roll unit 14 disposed between the feed roll 13 and the conveyer 6. The feed roll 13 is designed to continuously convey the fabric 2 at a speed that is an average of speeds at which it is conveyed intermittently by the conveyer 6.

Figure 3:
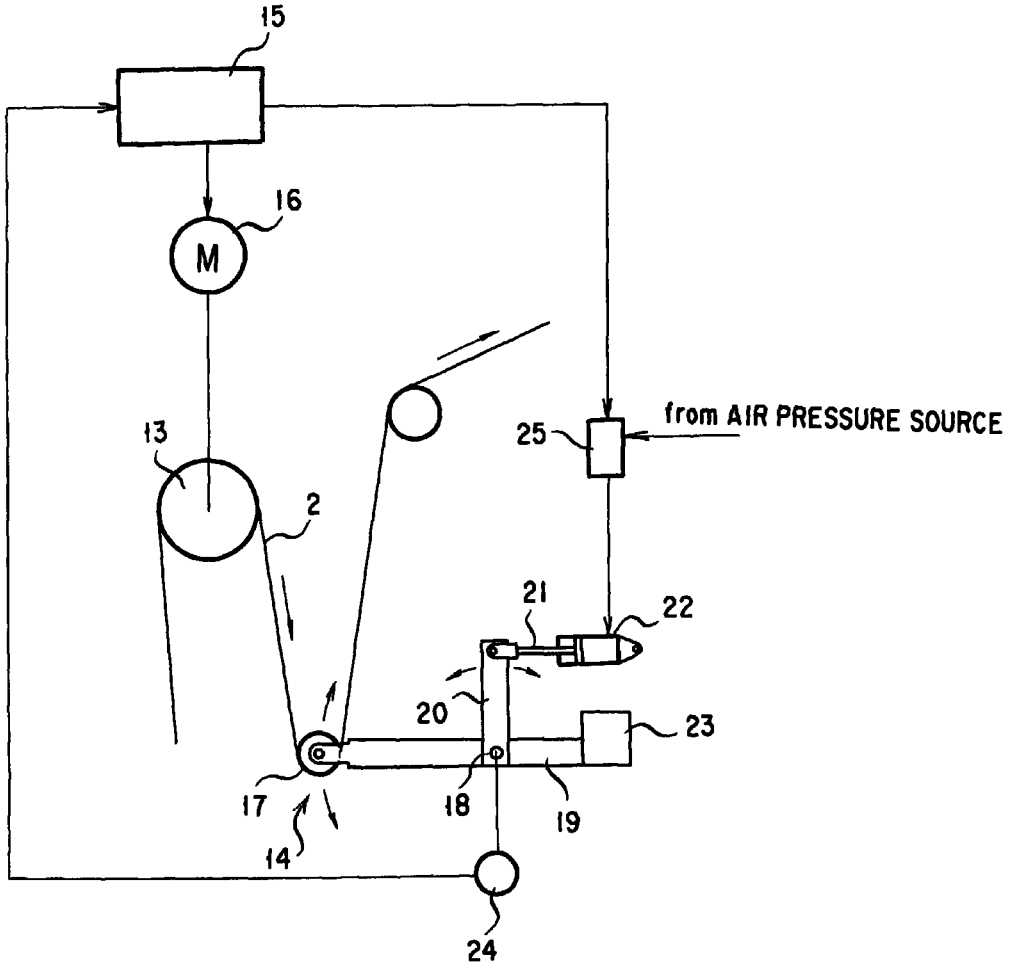
FIG. 3 is an explanatory view illustrating a feed roll and a dancer roll unit.

The feed roll 13 and the dancer roll unit 14 are configured as shown in FIG. 3. The feed roll 13 is designed to be driven by a drive motor 16 whose drive speed can be controllably adjusted by a controller 15.

The dancer roll unit 14 has a dancer roll 17 on which the fabric 2 is wound at a position lower than that at which it is wound on the feed roll 13. The dancer roll unit 14 includes a swing lever 19 which supports the dancer roll 17 at its one end and is designed to be swung vertically about a support shaft 18 as its fulcrum. It also includes a bellowphragm cylinder 22 whose base end is supported on the unit body so that its whole body is rockable vertically and whose piston rod 21 is coupled to an auxiliary lever 20 which is mounted on the swing lever 19. The dancer roll unit 14 also includes a balance weight 23 attached to the other end of the swing lever 19 for offsetting the weight of the dancer roll 17. Thus, the swing lever 19 is swung to move the dancer roll 17 vertically, thereby altering the path length of the fabric 2 between the feed roll 13 and the conveyer 6.

The support shaft 18 is rotated with a swing of the swing lever 19. A rotation angle detector 24 is provided to detect a rotation angle of the support shaft 18 and to output a detection signal which is input into the controller 15.

The bellowphragm cylinder 22 is operated by a pneumatic pressure from an electro-pneumatic converter 25 to elongate and its elongation causes the swing lever 19 to move the dancer roll 17 downwards.

The electro-pneumatic converter 25 as it is known from JP 2003-167633 A is able to adjust the pneumatic pressure from an air pressure source into the bellowphragm cylinder 22 according to the magnitude of an electric signal that is input. Note that a magnitude of the pneumatic pressure into the bellowphragm cylinder 22 can be set as desired.

Furnished with, pneumatic pressure via the electro-pneumatic converter 25 as mentioned above, the bellowphragm cylinder 22 can be operated under a constant pressure for an entire range of stroke of the piston rod 21. Also, as an object to be driven is varied in position, the bellowphragm cylinder 22 for a range of its stroke can be varied in its position as desired while imparting a constant pressure to the object. Therefore, it is always ensured that if the dancer roll 17 is moved up and down, as it is so moved the fabric 2 is imparted with a constant tension.

Using a bellowphragm cylinder 22 and an electropneumatic converter 25 in this way allows any behavior of a fabric 2 intermittently conveyed by the conveyer 6 to be absorbed by an up and down movement of the dancer roll 17 while maintaining a tension applied to the fabric 2 constant. And, a movement of the dancer roll 17 is represented by a detection signal from the rotation angle detector 24 which indicates a swing angle of the swing lever 19 as the dancer roll 17 is moved and which is fed back to the controller 15. Thus, when the dancer roll 17 is rapidly moved, the controller 15 is operated routinely in response to the signal from the rotation angle detector 24 to controllably adjust the rotational speed of the feed roll 13 so that the fabric 2 may be stably supplied from the fabric supply section 1 as the fabric 2 is kept continuously fed.

It should be noted that the tension may be applied to the fabric 2 through the dancer roll 17 not by the bellowphragm cylinder 26 but by an adjustment of the distance of the balance weight 23 from the support shaft 18 or an adjustment of the weight of the balance weight 23.

Figure 4A:
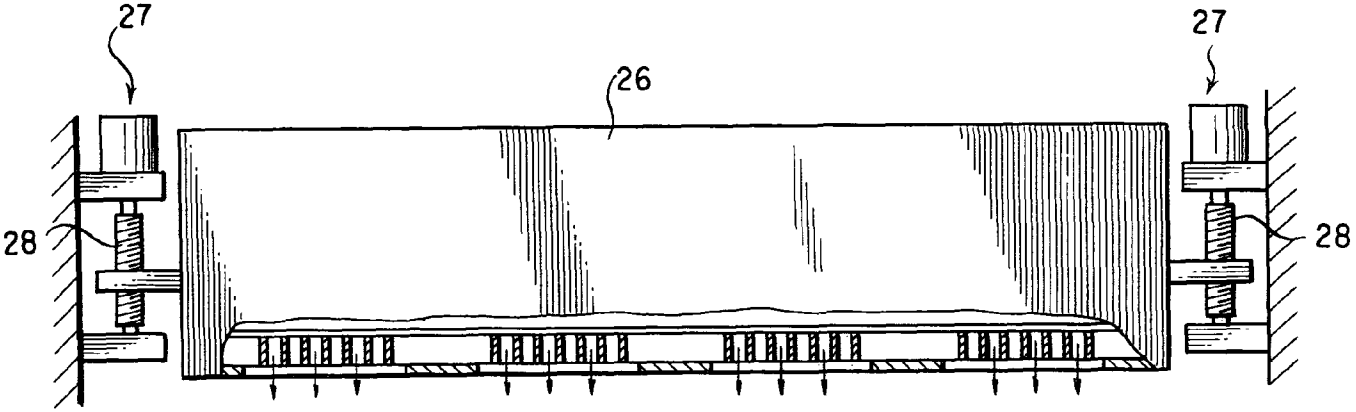
FIGS. 4A and 4B are elevational views in part broken illustrating dryers, respectively.
Figure 4B:
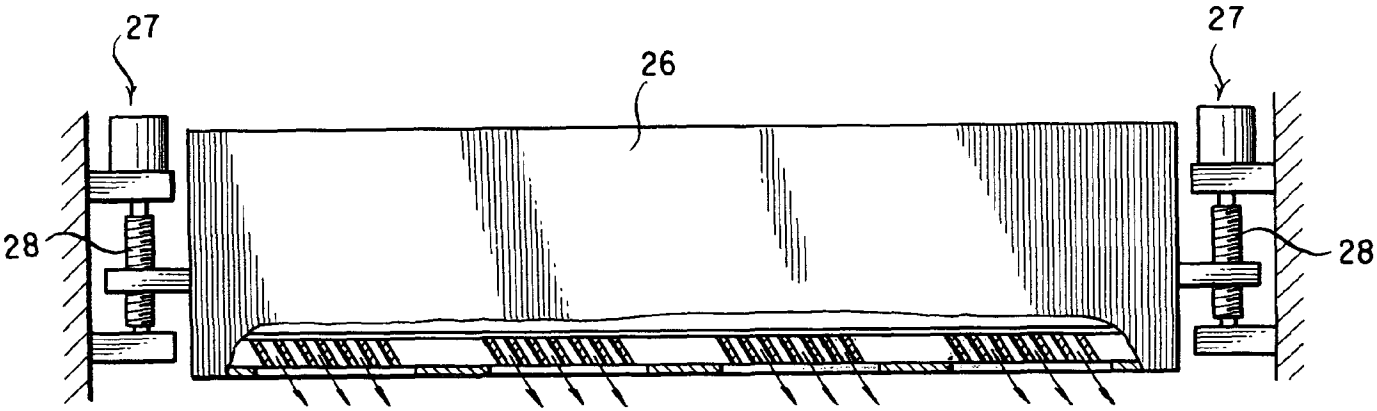

The drying section 4 is provided with a plurality of dryers 26 disposed in the traveling direction of the fabric 2. Each dryer 26 is arranged as opposed in position to a surface of the traveling fabric 2. And, such dryers 26 are of a type in which as shown in FIG. 4A hot air is blown out orthogonally to a surface of the fabric 2 and of a type in which as shown in FIG. 4B hot air is blown out obliquely to the width direction of the fabric 2, each dryer 26 being movable by a drive unit 27 towards and away from the surface of the fabric 2.

Such drive units 27 may be disposed at both sides of each of the dryer 26. For example, they may include screw rods 28 which are synchronously rotated 28 to move the dryer 26 up and down.

When both such types of dryer 26 are used for the drying section 4, the dryer 26 used at the upstream side may be of the obliquely blow-out type and the dryer 26 used at the downstream side may be of the orthogonally blow-out type. This allows the hot air to be blown out on the fabric 2 at the upstream side obliquely to its width direction so that an undried ink is prevented from diffusing to run while it is preliminarily dried, whereafter the hot air is allowed to blow out on the surface of the fabric 2 at the downstream side orthogonally thereto to dry the surface. And, the spacing then between an air outlet of each dryer 26 and the fabric 2 is suitably adjusted by each drive unit 27. Also, positioning each dryer 26 to move away from the fabric 2 when the ink jet recording section 3 starts and ceases its operation prevents the fabric 2 from damaging by such as burning. The direction in which the hot air is blown out in the dryer 26 disposed at the upstream side may be oblique either upstream or downstream in the traveling direction of the fabric 2.

In the ink jet recording apparatus shown in FIG. 1, a cloth guide 29 and a center guide 30 are also provided as disposed between the fabric supply section 1 and the feed roller 13 in order from upstream in the traveling direction of the fabric 2.

In the makeup mentioned above, the fabric 2 from the supply 1 may have longitudinal veining, if any, removed through the cloth guide 29 and dust, if any, removed through the center guide 30, regulating its position. The fabric 2 then is fed continuously into the ink jet recording section 3 by the feed roll 13 via the dancer roll unit 14. Then, in the ink jet recording section 3, the fabric 2 is intermittently conveyed by the conveyer 6 while being printed by the printing head unit 7. In this time period, the fabric 2 is pressed by the sticking roll 11 against the conveyer 6 at an upstream side of the conveyer 6 and the fabric 2 as thus stuck on the conveyer 6 is conveyed by the conveyer 6 to be printed without slippage relative to the conveyer 6.

The fabric 2 when continuously fed by the feed roll 13 into the ink jet recording section 3 as mentioned above is fed onto the conveyer 6, with a periodic slack which the fabric 2 has at an upstream side of the conveyer 6 because it is intermittently conveyed by the conveyer 6 but which is absorbed by the dancer roll unit 14, thus in the state that the fabric 2 has a predetermined tension applied and maintained constant.

The fabric 2 printed in the ink jet recording section 3 is unstuck from the conveyer 6 at its downstream end by being pulled to travel by the traction roll 12, whereafter it is dried in the drying section 4 and then folded by the folder section 5.

It should be noted here that while the fabric 2 is intermittently conveyed in the ink jet recording section 3, at its downstream side the fabric 2 is continuously pulled to travel by the traction roll 12. Therefore, the position at which the fabric 2 is unstuck from the conveyer 6 is intermittently displaced in the conveying direction thereof. That is, the position of unsticking as shown in FIG. 5 is moved to an upstream side "a" while the conveyer 6 is at a halt and to a down-stream side "b" while the fabric 2 is conveyed.

Figure 5:
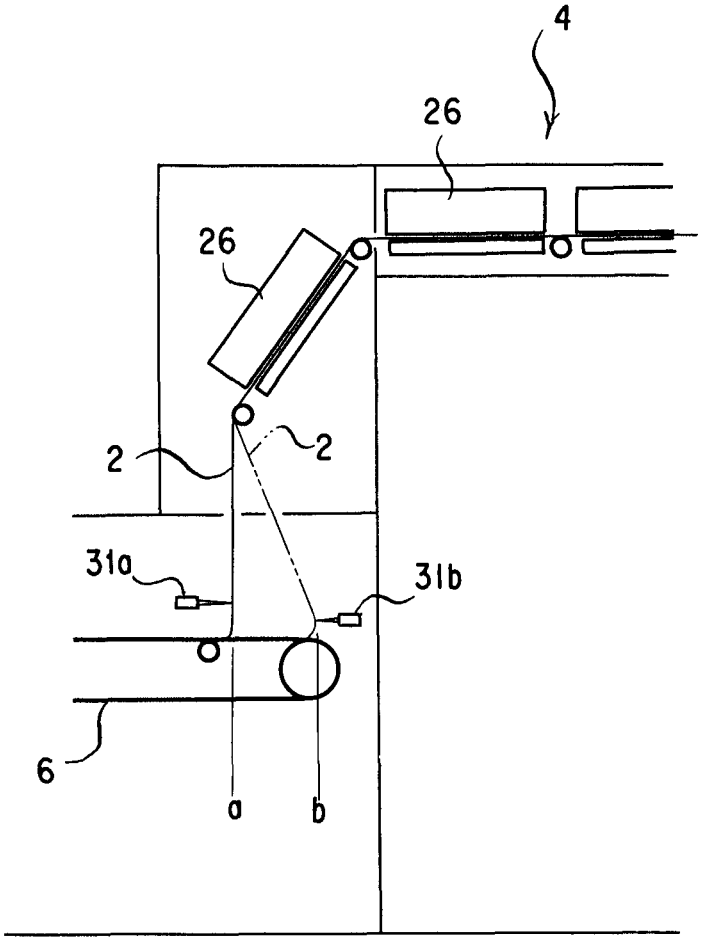
FIG. 5 is an explanatory view illustrating an area downstream of the ink jet recording section.

As shown further in FIG. 5, variable positions of unsticking of the fabric 2 from the conveyer 6 may be detected by fabric sensors 31*a* and 31*b*. The fabric sensors 31*a* and 31*b* may be disposed at a site upstream of the upstream unsticking position "a" and at a site down-stream of the downstream unsticking position "b", respectively, to detect the fabric 2 which is sited there, respectively, so that when the actual position of unsticking while the conveyer 6 is at a halt is upstream of the upstream unsticking position "a", this is detected by the upstream fabric sensor 31*a* and indicated by a signal which the latter provides and when the actual position of unsticking while the conveyer 6 is conveying is downstream of the downstream unsticking position "b", this is detected by the downstream fabric sensor 31*b* and indicated by a signal which the latter provides. A controller (not shown in this Figure) may be made responsive to the signal from the upstream fabric sensor 31*a* to slightly decrease the rate of traction by the traction roll 12 and responsive to the signal from the downstream sensor 31*b* to slightly increase the rate of traction by the traction roller 12.

This ensures that the unsticking position of the fabric 2 from the conveyer 6 ranges between both upstream and downstream unsticking positions "a" and "b" so that even the fabric rich in stretchability is allowed to travel through the drying section 4 and the folder section 5 without slacks.

What is claimed is:

1. An ink jet recording apparatus for textile printing, comprising:

an ink jet recording section of serial printing type including a conveyer for intermittently conveying a fabric to print on the fabric intermittently conveyed in the ink jet recording section;

a recording head unit disposed opposite to the conveyer from its upper side, said conveyer, interlocked with an operation of the recording head unit, is adapted to intermittently convey the fabric while the fabric is stuck onto the conveyer;

a feed roll for continuously feeding the fabric onto an upstream end of said conveyer, and a dancer roll unit, said feed roll and dancer roll unit being disposed upstream of said ink jet recording section in order from upstream in the traveling direction of the fabric;

the dancer roll unit is configured to move up and down in response to the intermittent movement of the fabric to maintain a constant tension on the fabric intermittently conveyed in the ink jet recording section;

a controller configured to detect a signal regarding the up and down movement of the dancer roll unit and, in response to the detected signal, the controller adjusting the rotational speed of the feed roll so that the fabric is continuously fed onto the upstream end of the conveyer; and a drying section, and a traction roll for continuously pulling the fabric from a downstream end of said conveyer for unsticking the fabric from the latter, said drying section and traction roll being disposed downstream of said ink jet recording section in order from upstream in the traveling direction of the fabric, wherein the traction roll adapted to continuously convey the fabric at a speed that is an average of speeds at which the fabric is conveyed intermittently by the conveyer, and wherein a position at which the fabric is unstuck from the conveyer is moved to an upstream side and a downstream side in the conveying direction of the fabric in response to the intermittent movement of the fabric.

2. An ink jet recording apparatus as set forth in claim 1, further comprising:

a drive motor for driving said feed roll, and a dancer roll operation detecting means disposed in said dancer roll unit for detecting a dancer roll operation of said dancer roll unit, wherein the controller for controllably adjusting drive speed of said drive motor in response to a signal from said dancer roll operation detecting means.

3. An ink jet recording apparatus as set forth in claim 1 or 2, further comprising:

a fabric sensor means for providing a detection signal which indicates that the unsticking position of the fabric in the downstream end of said conveyer deviates from a predetermined range of position, and a controller in response to the detection signal from said fabric sensor for increasing and decreasing the rate of traction by said traction roll.

4. An ink jet recording apparatus as set forth in claim 1 or 2, wherein:

said drying section comprises a first dryer for blowing hot air orthogonally to surfaces of the fabric and a second dryer for blowing hot air obliquely to surfaces of the fabric, the second dryer being disposed upstream of the first dryer.

5. An ink jet recording apparatus as set forth in claim 4, wherein:

said first and second dryers are movable towards and away from surfaces of the fabric.

6. An ink jet recording apparatus as set forth in claim 1 or 2, wherein:

the recording head unit having a plurality of rows of line heads disposed on a carriage movable on rails in a direction orthogonal to a traveling direction of the fabric, said rows of the line heads arranged parallel to each other in a moving direction of the carriage so that rows of nozzles of the line heads lie parallel to the traveling direction of the fabric.

7. An ink jet recording apparatus as set forth in claim 1, wherein:

the dancer roll unit comprises a dancer roll, a balance weight and a swing lever supporting said dancer roll at one end of said swing lever and said balance weight attached at another end of said swing lever so as to offset the weight of said dancer roll.

8. An ink jet recording apparatus as set forth in claim 7, wherein:

said swing lever is configured to pivot about a fulcrum having a support shaft rotatably mounted at the fulcrum of said swing lever to move the dancer roll vertically so as to alter a path length of the fabric between the feed roll and the conveyer.

9. An ink jet recording apparatus as set forth in claim 1, further comprising:

at least two fabric sensors for detecting an unsticking position, which is variable, and at which the fabric is unstuck from the conveyer;

one of said at least two fabric sensors is disposed closer to a downstream end of the conveyer in the conveying direction; and another one of said at least two fabric sensors is disposed upstream of said one fabric sensor.

* * * * *